US010391495B2

(12) United States Patent
Beebe et al.

(10) Patent No.: US 10,391,495 B2
(45) Date of Patent: Aug. 27, 2019

(54) DEFORMABLE WELL AND METHOD

(71) Applicant: Wisconsin Alumni Research Foundation, Madison, WI (US)

(72) Inventors: David J. Beebe, Monona, WI (US); David J. Guckenberger, Jr., Oconomowoc, WI (US); Hannah M. Pezzi, New Berlin, WI (US); Scott M. Berry, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 145 days.

(21) Appl. No.: 15/242,952

(22) Filed: Aug. 22, 2016

(65) Prior Publication Data

US 2018/0050338 A1 Feb. 22, 2018

(51) Int. Cl.
*B01L 3/00* (2006.01)

(52) U.S. Cl.
CPC ..... *B01L 3/505* (2013.01); *B01L 2200/16* (2013.01); *B01L 2300/0829* (2013.01); *B01L 2300/123* (2013.01)

(58) Field of Classification Search
CPC ..... B01L 3/505
See application file for complete search history.

(56) References Cited

U.S. PATENT DOCUMENTS 2,198,256 A * 4/1940 Levy ..... B01L 3/5021 241/DIG. 30
4,122,980 A * 10/1978 Laverty ..... A47K 5/1214 215/253
4,167,955 A * 9/1979 Sharples ..... B01L 3/0293 141/1
2004/0058452 A1 3/2004 Fisher et al.
2007/0017930 A1* 1/2007 Gorrie ..... B65D 35/28 222/103
2010/0028211 A1 2/2010 Treptow

FOREIGN PATENT DOCUMENTS

| | | |
|---|---|---|
| JP | 2006511808 | 4/2006 |
| JP | 2014206396 | 10/2014 |
| WO | 9636436 | 11/1996 |

OTHER PUBLICATIONS

Merriam-Webster definition of "cylinder".*
PCT/US2017/042987, international Search Report and Written Opinion, dated Oct. 26, 2017, 16 pages.

* cited by examiner

*Primary Examiner* — Paul S Hyun
(74) *Attorney, Agent, or Firm* — Boyle Fredrickson, S.C.

(57) ABSTRACT

A deformable well structure for a microtiter plate and method are provided. The deformable well structure includes a sample container defining a well for receiving a sample therein. The sample received in the well has a concave meniscus. A deformation tool is engageable with the sample container and is moveable between a first disengaged position wherein the deformation tool is spaced from the sample container and a second, engaged position wherein the deformation tool engages and deforms at least a portion of the sample container such that the meniscus of the sample in the well is converted from concave to convex.

13 Claims, 3 Drawing Sheets

DEFORMABLE WELL AND METHOD

REFERENCE TO GOVERNMENT GRANT

This invention was made with government support under CA181648 and CA014520 awarded by the National Institutes of Health and 2010-ST-061-FD0001 awarded by the DHS/ST. The government has certain rights in the invention.

FIELD OF THE INVENTION

The present invention relates generally to the preparation of samples in wells of a microtiter plate, and in particular, to a deformable well for a microtiter plate and method wherein deformation of the well converts the meniscus of a sample in the well from concave to convex.

BACKGROUND AND SUMMARY THE INVENTION

The use of a sliding lid for immobilized droplet extraction technology provides a simple approach to sample preparation. The technology contemplates a lower microtiter plate with a plurality of wells for receiving biological samples therein. An upper plate has a lower surface directed to the upper surface of the microliter plate. A force is positioned adjacent the upper plate and attracts target bound solid phase substrate in the biological sample toward the lower surface of the upper plate. The upper plate is movable from a first position wherein the target bound solid phase substrate in the biological samples are drawn to the lower surface of the upper plate and a second position wherein the target bound solid phase substrate are isolated from the biological samples.

The technology is enabled through the use of a hydrophobic lower surface of the upper plate in combination with the convex menisci of the biological samples in the plurality of wells in microtiter plate, which facilitate fluidic contact with the lower surface of the upper plate. Heretofore, to achieve the convex menisci, the wells of the microtiter plate must be accurately filled. However, such process has certain limitations. First, the stability of a convex droplet is low, as compared to a concave meniscus, making the droplets prone to spilling over the edges of the wells of the microtiter plate. The issue of spillage is exacerbated with fluids having low surface tension (e.g., lysis buffers, ethanol based solutions, detergents). As a result, the microtiter plate may be difficult to move or transport after the wells of the microtiter plates have been filled, thereby hindering the advanced preparation of plates and the disposing of plates without spillage. Second, convex droplets are difficult and/or impractical to prepackage, in part due to the aforementioned limitations. Hence, reagents must be packaged in separate containers, and thereafter, transferred to the wells of the microtiter plate. This, in turn adds steps and complexity to the process. As such, it is highly desirable to provide a mechanism which allows for the reagents/biological samples to remain concave until ready for use. Such a mechanism would enable the reagents/biological samples to be prepackaged on-chip, would simplify user protocols, and would assure that the reagents/biological samples remain in the wells of the microtiter plate so as to allow a user to manipulate the microtiter plate without the fear of spillage of the reagents/biological samples.

Therefore, it is a primary object and feature of the present invention to provide a deformable well for a microtiter plate wherein deformation of the well converts the meniscus of the sample in the well from concave to convex.

It is a further object and feature of the present invention to provide a deformable well for a microtiter plate which allows for reagents/biological samples to be prepackaged therein.

It is a still further object and feature of the present invention to provide a deformable well for a microtiter plate which allows for a user to manipulate the microliter plate without the fear of spillage of the reagents/biological samples prepackaged therein.

It is a still a further object and feature of the present invention to provide a deformable well for a microtiter plate which is simple to use and inexpensive to manufacture.

In accordance with the present invention, a deformable well structure for a microtiter plate is provided. The well structure includes a sample container defining a well for receiving a sample therein. The sample received in the well, has a concave meniscus. A deformation tool is engageable with the sample container and is moveable between a first disengaged position wherein the deformation tool is spaced from the sample container and, a second engaged position wherein the deformation tool engages and deforms at least a portion of the sample container such that the meniscus of the sample in the well is converted from concave to convex.

The sample container includes a generally tubular wall having a first end defining an opening in communication with the well and a second end; and a generally flat wall closing the second end of the tubular wall. The tubular wall may be fabricated from a shape-memory polymer. It is further contemplated for the tubular wall to include a circumferentially extending bellows section formed therein. The bellows section is defined by a plurality of axially compressible pleats formed in the tubular wall.

The deformation tool may include a support bar having a recess. The recess is adapted for receiving the sample container therein. The sample container has a first cross-sectional dimension and the recess in the support bar is defined by first and second spaced sidewalls. The first and second sidewalls defining the recess in the support bar are spaced by a distance less than the cross-sectional dimension of the sample container.

In accordance with a further aspect of the present invention, a deformable well structure for a microliter plate is provided for receiving, a sample fluid therein. The deformable well structure includes a generally tubular wall having an inner surface, a first end defining an opening in communication with the well and a second end. An end wall closes the second end of the tubular wall and has an inner surface. The inner surface of the tubular wall and the inner surface of the end wall defines a well for receiving the sample fluid therein. The sample fluid received in the well has a concave meniscus. Deformation of the tubular wall converts the meniscus of the sample fluid in the well from concave to convex.

The tubular wall may be fabricated from a shape-memory polymer or include a circumferentially extending bellows section formed therein. The bellows section is defined by a plurality of axially compressible pleats formed in the tubular wall. A deformation tool may be engageable with the sample container and is configured to deform the tubular wall. The deformation tool is moveable between a first disengaged position wherein the deformation tool is spaced from the tubular wall and a second engaged position wherein the deformation tool engages and deforms the tubular wall. The deformation tool may include a support bar having first and second spaced sidewalls defining a recess therebetween. The first and second spaced sidewalls are adapted to engage and to deform the tubular wall received in the recess.

In accordance with a still further aspect of the present invention, a method of converting the meniscus of a sample fluid received in a well from concave to convex is provided. The method includes the step of filling a sample container defining the well with the sample fluid. The sample container includes a generally tubular wall having a first end defining an opening in communication with the well and a second end. An end wall closes the second end of the tubular wall. The tubular wall is deformed so as to convert the meniscus of the sample fluid in the well from concave to convex.

Tubular wall may be fabricated from a shape-memory polymer. A circumferentially extending bellows section may be fabricated in the tubular wall. The bellows section is defined by a plurality of axially compressible pleats. The tubular wall may be engaged with a deformation tool. The deformation tool configured to deform the tubular wall upon contact. The deformation tool may include a support bar having first and second spaced sidewalls defining a recess therebetween. The first and second spaced sidewalls are adapted to engage and to deform the tubular wall received in the recess.

BRIEF DESCRIPTION OF THE DRAWINGS

The drawings furnished herewith illustrate a preferred construction of the present invention in which the above aspects, advantages and features are clearly disclosed as well as others which will be readily understood from the following description of the illustrated embodiments.

In the drawings.

DETAILED DESCRIPTION OF THE DRAWINGS

Figure 1:
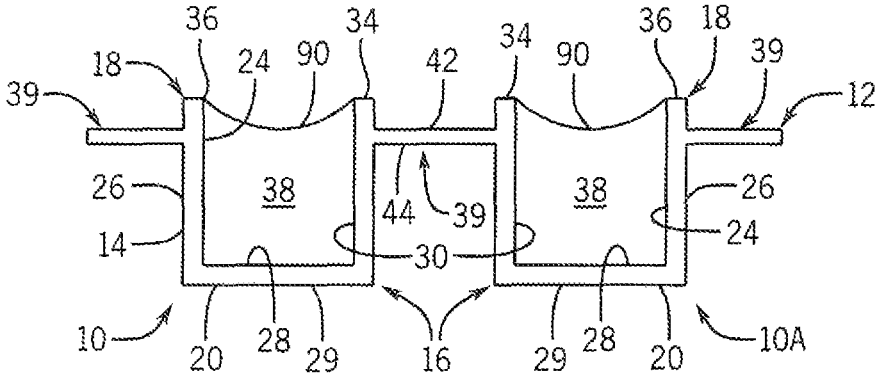
FIG. 1 a schematic, cross-sectional view of first and second deformable wells in accordance with the present invention in a microliter plate.
Figure 2:
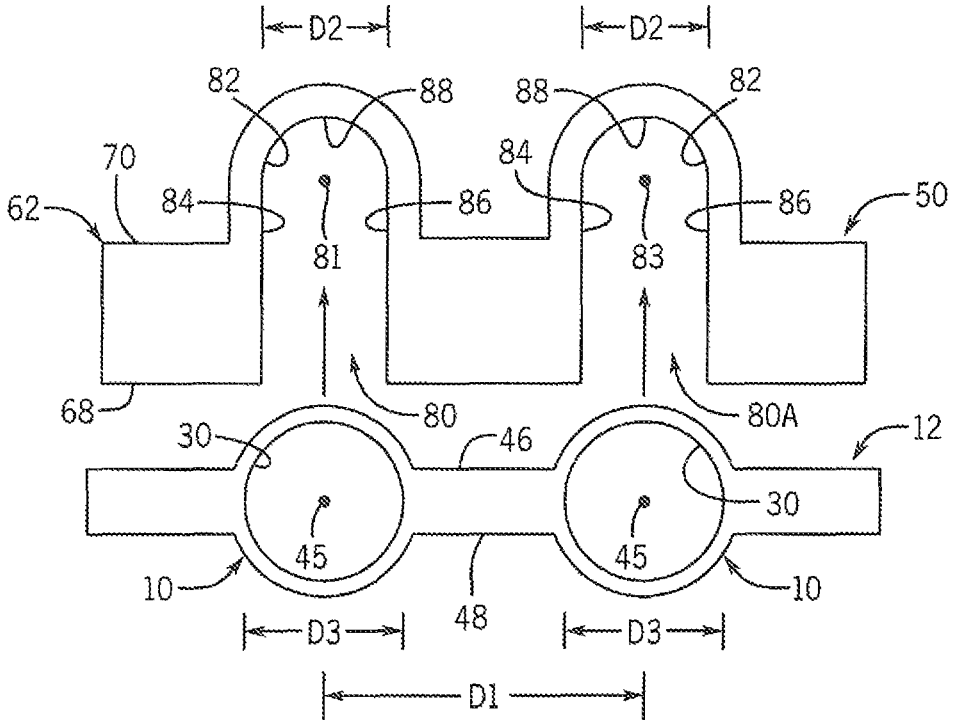
FIG. 2 is a top plan view of the microliter plate of FIG. 1 and a deformation tool in a non-engaged position.
Figure 3:
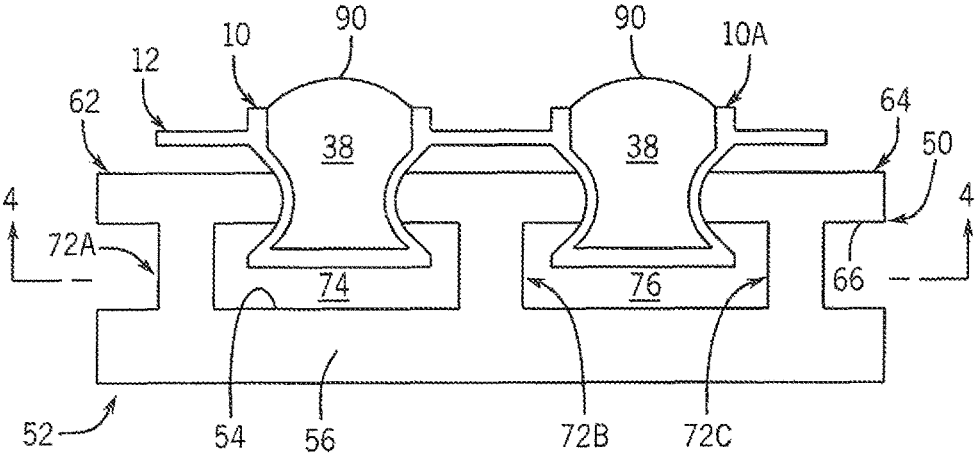
FIG. 3 is side elevational view of the microliter plate of FIG. 1 and the deformation tool of FIG. 2 in an engaged position.

Referring to FIGS. 1-3, a first embodiment device of a deformable well in accordance with the present invention is generally designated by the reference numerals 10 and 10*a*. It is intended for a plurality of deformable wells 10 and 10*a* to be incorporated into microliter plate 12, as hereinafter described. Additional deformable wells may be provided in microliter plate 12 without deviating from the scope of the present invention. Further, it is noted that each deformable well 10 and 10*a* is identical in structure. As such, it is understood that the following description of deformable well 10 is intended to describe deformable well 10*a* and any other deformable well in microtiter plate 12 as if fully described herein.

Deformable well 10 includes a generally cylindrical wall 14 having a closed lower end 16 and an open upper end 18. Preferably, cylindrical wall 14 is fabricated from a shape-memory polymer such that after deformation, cylindrical wall 14 would have the ability to return from a deformed state to its original/permanent state, as hereinafter described. However, it can be appreciated that cylindrical wall may be fabricated from other materials, such as a thin, flexible plastic, without deviating from the scope of the present invention. Cylindrical wall 14 is defined by a generally cylindrical inner surface 24 and a generally cylindrical outer surface 26 interconnected to inner surface 24 and, by upper edge 34. Upper edge 34 of cylindrical wall 14 defines opening 36 in upper end 18 thereof.

Lower end 16 of cylindrical wall 14 is closed by lower wall 20. As best seen in FIG. 3, lower wall 20 may be fabricated from a rigid material which retains its shape as cylindrical wall 14 transitions between its original state, FIG. 1, and its deformed state, FIG. 3. Alternatively, lower wall 20 may be fabricated from a shape-memory polymer such that, if deformed during deformation of cylindrical wall 14, lower wall 16 has the ability to return to its original state as cylindrical wall 14 transitions from its deformed state to its original state. Lower wall 20 is defined by a generally cylindrical inner surface 28 and a generally cylindrical outer surface 29. Inner surface 24 of cylindrical wall 14 and inner surface 28 of lower wall 20 define chamber 30 for receiving fluid 38 therein. It can be appreciated that opening 36 in upper end of cylindrical wall 14 allows for fluid communication between the interior of chamber 30 of deformable well 10 and a selected fluid transfer mechanism.

As best seen in FIGS. 1-2, adjacent deformable wells 10 and 10*a* are interconnected by connection sections 39 of microtiter plate 12. More specifically, connection section 39 of microtiter plate 12 extends between outer surface 26 of cylindrical wall 14 of deformable well 10 at a location spaced from open upper end 18 of cylindrical wall 14 to outer surface 26 of cylindrical wall 14 of adjacent deformable well 10*a* at a location spaced from open, upper end 18 of cylindrical wall 14. Connection section 39 of microliter plate 12 is generally flat and includes first and second opposite sides 42 and 44, respectively, and parallel first and second sides 46 and 48, respectively. It is contemplated for center points 45 of adjacent deformable wells 10 and 10*a* of microtiter plate 12 to be spaced by a distance D1, FIG. 2.

Figure 4:
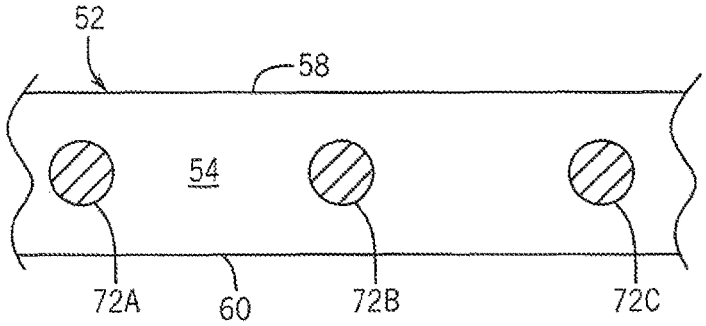
FIG. 4 is a cross-sectional view of the deformation tool taken along line 4-4 of FIG. 3.

In order to deform deformable wells 10 and 10*a* in a predictable manner, as hereinafter described, fixture 50 is provided. Fixture 50 includes a lower support bar 52 having an upper surface 54 and a lower surface 56 interconnected by first and second, sides 58 and 60, respectively, FIGS. 3-4. Fixture 50 further includes an upper support bar 62 having an upper surface 64 and a lower surface 66 interconnected by first and second sides 68 and 70, respectively, FIGS. 2-3. Upper support bar 62 is spaced from and axially aligned with lower support bar 52. Upper surface 54 of lower support bar 52 is interconnect to lower surface 66 of upper support bar 62 by a plurality of spaced posts 72*a*-72*c*. Posts 72*a* and 72*b* define a first chamber 74 therebetween for receiving a portion of deformable well 10 with microtiter plate received within fixture 50, as herein described. Posts 72*b* and 72*c* define a second chamber 76 therebetween for receiving a portion of deformable well 10*a* with microtiter plate received within fixture 50, as herein described.

First side 68 of upper support bar 62 includes a plurality of spaced recesses 80 and 80*a* formed therein. Recesses 80 and 80*a* are identical in structure. As such, it is understood that the following description of recess 80 it intended to describe recesses 80*a* in upper support bar 62 of fixture 50 as if fully described herein. Recess 80 is defined by recessed surface 82 in first side 68. Recessed surface 82 includes first and second generally parallel, spaced portions 84 and 86, respectively, interconnected by a generally concave, arcuate portion 88. The distance D2 between first and second portions 84 and 86, respectively, of recessed surface 82 of each recess 80 and 80*a* is less than the diameters D3 of deformable wells 10 and 10*a*, for reasons hereinafter described. It is further contemplated for adjacent recesses 80 and 80*a* to be spaced from each other such that the midpoint 81 between first and second generally parallel, spaced portions 84 and 86, respectively, of recess 80 is spaced from the midpoint 83 between first and second generally parallel, spaced portions 84 and 86, respectively, of adjacent recess 80*a* by a distance generally equal to the distance D1 between center points 45 of adjacent deformable wells 10 and 10*a* of microliter plate 12 to facilitate alignment of deformable wells 10 and 10*a* of microtiter plate 12 with corresponding recesses 80 and 80*a*, respectively, in fixture 50.

In operation, chambers 30 in deformable wells 10 and 10*a* of microliter plate 12 are filled with fluid 38. As best seen in FIG. 1, fluid 38 in deformable wells 10 and 10*a* of microtiter plate 12 have generally concave menisci 90. In order to reverse the shapes of concave menisci 90 of fluid 38 in deformable wells 10 and 10*a* to be convex, microtiter plate 12 aligned with fixture 50 such that each deformable wells 10 and 10*a* is aligned with a corresponding recess 80 and 80*a*, respectively, in fixture 50. Thereafter, microliter plate 12 is inserted into fixture 50 such that each deformable well 10 received between first and second, portions 84 and 86, respectively, of recessed surface 82 of recess 80 and such that upper support bar 62 is located between connection sections 39 of microtiter plate 12 and lower support bar 52. Similarly, deformable well 10*a* is received between first and second portions 84 and 86, respectively, of recessed surface 82 of recess 80*a* such that upper support bar 62 is located between connection sections 39 of microtiter plate 12 and lower support bar 52. As deformable wells 10 and 10*a* are inserted into corresponding recesses 80 and 80*a*, respectively, in fixture 50, cylindrical wall 14 of deformable well 10 and cylindrical wall 14 of deformable well 10*a* are deformed such that the volumes of deformable wells 10 and 10*a* are reduced in a predictable manner. Reducing the volumes of deformable wells 10 and 10*a* causes a reversal in the shape of the menisci 90 of fluid 38 such that menisci 90 become convex, FIG. 3.

Figure 2A:
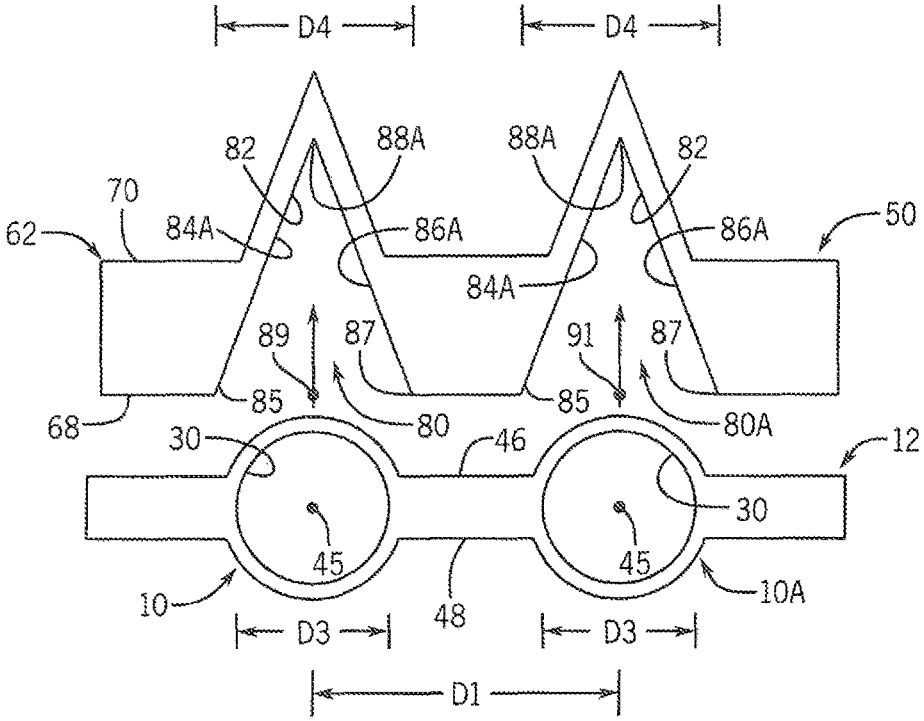
FIG. 2*a* is a top plan view of the microliter plate of FIG. 1 and an alternate deformation tool in a non-engaged position.

Alternatively, referring to FIG. 2*a*, it is contemplated for recessed surface 82 in first side 68 of upper support bar 62 to be defined by first and second diverging portions 84*a* and 86*a*, respectively, extending from a common vertex 88*a*. The distance D4 between terminal ends 85 and 87 of first and second diverging portions 84*a* and 86*a*, respectively, of recessed surface 82 of each recess 80 and 80*a* is greater than the diameters D3 of deformable wells 10 and 10*a*. In addition, it is further contemplated for adjacent recesses 80 and 80*a* to be spaced from each other such that the midpoint 89 between terminal ends 85 and 87 of first and second diverging portions 84*a* and 86*a*, respectively, of recess 80 is spaced from the midpoint 91 between terminal ends 85 and 87 of first and second diverging portions 84*a* and 86*a*, respectively, of adjacent recess 80*a* by a distance generally equal to the distance D1 between center points 45 of adjacent deformable wells 10 and 10*a* of microtiter plate 12 to facilitate alignment of deformable wells 10 and 10*a* of microtiter plate 12 with corresponding recesses 80 and 80*a*, respectively, in fixture 50.

In operation, as microtiter plate 12 is inserted into fixture 50, each deformable well 10 is received between first and second portions 84*a* and 86*a*, respectively, of recessed surface 82 of recess 80 and deformable well 10*a* is received between first and second portions 84*a* and 86*a*, respectively, of recessed surface 82 of recess 80*a*. As deformable wells 10 and 10*a* are inserted into corresponding recesses 80 and 80*a*, respectively, in fixture 50, cylindrical wall 14 of deformable well 10 and cylindrical wall 14 of deformable well 10*a* are deformed such that the volumes of deformable wells 10 and 10*a* are reduced in a predictable manner. It can be appreciated that as deformable wells 10 and 10*a* are inserted further into corresponding recesses 80 and 80*a*, respectively, toward vertices 88*a*, cylindrical wall 14 of deformable well 10 and cylindrical wall 14 of deformable well 10*a* are further deformed thereby gradually reducing the volumes of deformable wells 10 and 10*a*. Hence, it can be understood that the further insertion of deformable wells 10 and 10*a* into corresponding recesses 80 and 80*a*, respectively, will not only cause a reversal in the shape of the menisci 90 of fluid 38 such that menisci 90 become convex, but allow for a user to control the height of the convex, menisci 90 of fluid 38 and the volume of fluid 38 within deformable wells 10 and 10*a*.

Figure 5:
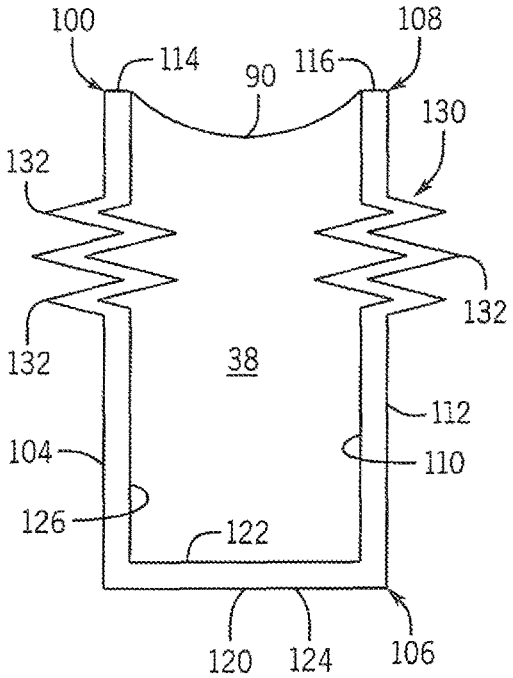
FIG. 5 is a schematic, cross-sectional view of an alternate embodiment of a deformable well in accordance with the present invention in a non-deformed configuration.
Figure 6:
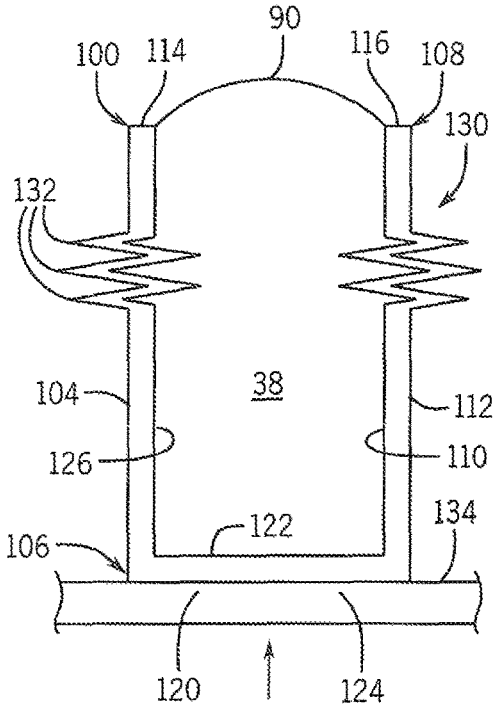
FIG. 6 is a schematic, cross-sectional view of the deformable well of FIG. 5 in a deformed configuration.

Referring to FIGS. 5-6, a second embodiment device of a deformable well for microtiter plate 12 is generally designated by the reference numeral 100. It is intended for a plurality of deformable wells 100 to be incorporated into microtiter plate 12 without deviating from the scope of the present invention. Deformable well 100 includes a generally cylindrical wall 104 having a closed lower end 106 and an open upper end 108. It is contemplated to fabricate cylindrical wall 104 from a shape-memory polymer such that upon deformation, cylindrical wall 104 has the ability to return from a deformed state to its original/permanent state, as hereinafter described. However, it can be appreciated that cylindrical wall may be fabricated from other materials, such as a thin, flexible plastic, without deviating from the scope of the present invention. Cylindrical wall 104 is defined by a generally cylindrical inner surface 110 and a generally cylindrical outer surface 112 interconnected to inner surface 110 by upper edge 114. Upper edge 114 of cylindrical wall 104 defines opening 116 in upper end 108 thereof.

Lower end 106 of cylindrical wall 104 is closed by lower wall 120 fabricated from a rigid material which retains its shape as cylindrical wall 104 transitions between its original state and its deformed state. Lower wall 120 is defined by a generally cylindrical inner surface 122 and a generally cylindrical outer surface 124. Inner surface 110 of cylindrical wall 104 and inner surface 122 of lower wall 120 define chamber 126 for receiving fluid 38 therein. It can be appreciated that opening 116 in upper end 108 of cylindrical wall 104 allows for fluid communication between the interior of chamber 126 of deformable well 100 and a selected fluid transfer mechanism.

To facilitate deformation of deformable well 100 in a predictable manner, cylindrical wall 104 may include a circumferentially extending bellows section 130. More specifically, bellows section 130 includes axially compressible pleats 132 formed therein. In operation, chamber 126 of deformable well 100 of microtiter plate 12 is filled with fluid 38. As best seen in FIG. 5, fluid 38 in deformable well 100 of microtiter plate 12 has a generally concave meniscus 90. In order to reverse the shape of concave meniscus 90 of fluid 38 in deformable well 100 to be convex, a generally flat surface 134 such as fixture, table top or user's hand is positioned against outer surface 124 of lower wall 106 of deformable well 100. Thereafter, flat surface 134 is urged axially against lower wall 120 such that pleats 132 of bellows section 130 of cylindrical wall 104 collapse in a predictable manner for a desired axial distance. As cylindrical wall 104 of deformable well 100 collapses, the volume of chamber 126 of deformable well 100 is reduced. This reduction in volume of chamber 126 of deformable well 100 causes a reversal in the shape of meniscus 90 of fluid 38 such that meniscus 90 is convex.

It can be appreciated that the above descriptions of devices are merely exemplary of the present invention. Various modes of carrying out the invention are contemplated as being within the scope of the following claims particularly pointing out and distinctly claiming the subject matter, which is regarded as the invention.

We claim:

1. A deformable well structure for a microtiter plate, comprising:

a sample container including a generally cylindrical wall at least partially defining a well for receiving a sample therein; and a deformation tool including a fixture having:

a support bar; and a recessed surface in the support bar defining a recess and being engageable with the wall of the sample container, the recessed surface having a position fixed relative to the support bar;

wherein:

one of the sample container and the fixture being moveable between a first disengaged position wherein the sample container is spaced from the recessed surface in the support bar and a second engaged position wherein the sample container is received in the recess in the support bar and engages the recessed surface in the support bar;

the recessed surface defining the recess in the support bar deforms at least a portion of the sample container with the sample container received in the recess such that the meniscus of the sample in the well is convex;

the sample container has a first cross-sectional dimension greater than a cross-sectional dimension of the recess in the first disengaged position and in the second engaged position such that the recessed surface deforms the sample container as the sample container and the fixture are relatively moved from the first disengaged position to the second engaged position.

2. The deformable well structure of claim 1 wherein the cylindrical wall of the sample container includes a first end defining an opening in communication with the well and a second end and wherein the sample container further includes a generally flat wall closing the second end of the cylindrical wall of the sample container.

3. The deformable well structure of claim 2 wherein the cylindrical wall is fabricated from a shape-memory polymer.

4. The deformable well structure of claim 1 wherein the recessed surface in the support bar is defined by first and second spaced sidewalls, the first and second sidewalls defining the recess in the support bar being spaced by a distance less than the cross-sectional dimension of the sample container.

5. The deformable well structure of claim 1 wherein the one of the sample container and the fixture of the deformation tool is moveable between the second engaged position and a third engaged position, wherein the convex meniscus of sample fluid has a first height with the one of the sample container and the fixture of the deformation tool in the second engaged position and a second height with the deformation tool in the third engaged position.

6. A deformable well structure for a microtiter plate for receiving a sample fluid therein, comprising:

a generally tubular wall having an inner surface, a first end defining an opening and a second end;

an end wall closing the second end of the tubular wall and having an inner surface, the inner surface of the tubular wall and the inner surface defining a well for receiving the sample fluid therein; and a volume reduction arrangement configured to selectively alter a configuration of the tubular wall, the volume reduction arrangement including a fixture having:

a support bar; and a recessed surface in the support bar defining a recess and being engageable with the tubular wall, the recessed surface having a position fixed relative to the support bar;

wherein:

one of the tubular wall and the fixture being moveable between a first disengaged position wherein the tubular wall is spaced from the recessed surface of the support bar and a second engaged position wherein at least a portion of the tubular wall is received in the recess in the support bar and engages the recessed surface of the support bar;

the sample fluid has a meniscus;

movement of the one of the tubular wall and the fixture of the volume reduction arrangement to the second engagement position results in the meniscus of the sample fluid projecting from the opening in the tubular wall and being convex; and the tubular wall has a first cross-sectional dimension greater than a cross-sectional dimension of the recess in the first disengaged position and in the second engaged position such that the recessed surface deforms the tubular wall as the tubular wall and the fixture are relatively moved from the first disengaged position to the second engaged position.

7. The deformable well structure of claim 6 wherein the deformation of the tubular wall reduces the volume of the well.

8. The deformable well structure of claim 6 wherein the tubular wall is fabricated from a shape-memory polymer.

9. The deformable well structure of claim 6 wherein the recessed surface of the fixture includes first and second spaced sidewalls defining the recess therebetween, the first and second spaced sidewalls adapted to engage and to deform the tubular wall received in the recess.

10. A deformable well structure for a microtiter plate for receiving a sample fluid therein, comprising:

a generally tubular wall having an inner surface, a first end defining an opening and a second end;

an end wall closing the second end of the tubular wall and having an inner surface, the inner surface of the tubular wall and the inner surface defining a well for receiving the sample fluid therein; and a volume reduction arrangement configured to selectively alter a configuration of the tubular wall, the volume reduction arrangement including a fixture having a recessed surface defining a recess in the fixture;

wherein:

one of the tubular wall and the fixture being moveable between a first disengaged position wherein the tubular wall is spaced from the recessed surface of the fixture and a second engaged position wherein at least a portion of the tubular wall is received in the recess in the fixture and engages the recessed surface of the fixture;

the sample fluid has a meniscus;

movement of the one of the tubular wall and the fixture of the volume reduction arrangement to the second engagement position results in the meniscus of the sample fluid projecting from the opening in the tubular wall and being convex; and the end wall is rigid and closes off the second end of the tubular wall.

11. A method of forming a convex meniscus of a sample fluid received in a well, comprising the steps of:

filling a sample container defining the well with the sample fluid, the sample container including:

a generally tubular wall having a first end defining an opening in communication with the well and a second end; and an end wall closing the second end of the tubular wall;

providing a fixture having:

a support bar; and a recessed surface in the support bar defining a recess, the recessed surface having a position fixed relative to the support bar; and moving one of the sample container and the fixture between a first disengaged position wherein the sample container is spaced from the recessed surface of the support bar and a second engaged position wherein the sample container is received in the recess in the support bar such that the tubular wall engages the recessed surface in the support bar and deforms;

wherein:

deformation of the tubular wall causes the sample fluid to form a convex meniscus; and the sample container has a first cross-sectional dimension greater than a cross-sectional dimension of the recess in the first disengaged position and in the second engaged position such that the recessed surface deforms the sample container as the sample container and the fixture are relatively moved from the first disengaged position to the second engaged position.

12. The method of claim 11 comprising the additional step of fabricating the tubular wall from a shape-memory polymer.

13. The method of claim 11 wherein the recessed surface includes first and second spaced sidewalls defining the recess therebetween, the first and second spaced sidewalls adapted to engage and to deform the tubular wall received in the recess.

* * * * *